US005853158A

United States Patent [19]

Riggle

[11] Patent Number: 5,853,158

[45] Date of Patent: Dec. 29, 1998

[54] BEVERAGE CONTAINER HOLDER

[76] Inventor: Christopher T. Riggle, 1208 Robbins St., Philadelphia, Pa. 19111

[21] Appl. No.: 954,776

[22] Filed: Oct. 22, 1997

[51] Int. Cl.[6] ..... A47K 1/08

[52] U.S. Cl. ..... 248/311.2; 248/103; 248/278.1

[58] Field of Search ..... 248/311.2, 278.1, 248/104, 103, 106

[56] References Cited

U.S. PATENT DOCUMENTS

| | | | |
|---|---|---|---|
| 4,453,695 | 6/1984 | Sennott et al. | 248/278.1 X |
| 4,735,388 | 4/1988 | Marks | 248/103 |
| 4,878,642 | 11/1989 | Kirby et al. | 248/311.2 |
| 4,997,156 | 3/1991 | Allen | 248/311.2 |
| 5,489,075 | 2/1996 | Ible | 248/104 |
| 5,732,920 | 3/1998 | Reynoso et al. | 248/278.1 |

*Primary Examiner*—Ramon O. Ramirez

[57] ABSTRACT

A new beverage container holder for providing an adjustably positionable device for holding a beverage to a structure. The inventive device includes a receptacle member for holding a beverage container coupled to an elongate arm member. A connection means connects the arm member to an clamping assembly designed for detachable attachment to a structure. The connection means includes a first pivot member, a second pivot member, and a rotation member to permit selective and adjustable positioning of the receptacle member in relation to the structure.

10 Claims, 3 Drawing Sheets

BEVERAGE CONTAINER HOLDER

BACKGROUND OF THE INVENTION

1. Field of the Invention

The present invention relates to beverage container holders and more particularly pertains to a new beverage container holder for providing an adjustably positionable device for holding a beverage to a structure.

2. Description of the Prior Art

The use of beverage container holders is known in the prior art. More specifically, beverage container holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage container holders include U.S. Pat. No. 5,195,650; U.S. Pat. No. 4,919,380; U.S. Pat. No. 4,697,780; U.S. Pat. No. 4,063,701; U.S. Pat. No. 5,356,107; and U.S. Pat. No. 4,997,156.

While these devices fulfill their respective, particular objectives and requirements, the aforementioned patents do not disclose a new beverage container holder. The inventive device includes a receptacle member for holding a beverage container coupled to an elongate arm member. A connection means connects the arm member to an clamping assembly designed for detachable attachment to a structure. The connection means includes a first pivot member, a second pivot member, and a rotation member to permit selective and adjustable positioning of the receptacle member in relation to the structure.

In these respects, the beverage container holder according to the present invention substantially departs from the conventional concepts and designs of the prior art, and in so doing provides an apparatus primarily developed for the purpose of providing an adjustably positionable device for holding a beverage to a structure.

SUMMARY OF THE INVENTION

In view of the foregoing disadvantages inherent in the known types of beverage container holders now present in the prior art, the present invention provides a new beverage container holder construction wherein the same can be utilized for providing an adjustably positionable device for holding a beverage to a structure.

The general purpose of the present invention, which will be described subsequently in greater detail, is to provide a new beverage container holder apparatus and method which has many of the advantages of the beverage container holders mentioned heretofore and many novel features that result in a new beverage container holder which is not anticipated, rendered obvious, suggested, or even implied by any of the prior art beverage container holders, either alone or in any combination thereof.

To attain this, the present invention generally comprises a receptacle member for holding a beverage container coupled to an elongate arm member. A connection means connects the arm member to an clamping assembly designed for detachable attachment to a structure. The connection means includes a first pivot member, a second pivot member, and a rotation member to permit selective and adjustable positioning of the receptacle member in relation to the structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage container holder apparatus and method which has many of the advantages of the beverage container holders mentioned heretofore and many novel features that result in a new beverage container holder which is not anticipated, rendered obvious, suggested, or even implied by any of the prior art beverage container holders, either alone or in any combination thereof.

It is another object of the present invention to provide a new beverage container holder which may be easily and efficiently manufactured and marketed.

It is a further object of the present invention to provide a new beverage container holder which is of a durable and reliable construction.

An even further object of the present invention is to provide a new beverage container holder which is susceptible of a low cost of manufacture with regard to both materials and labor, and which accordingly is then susceptible of low prices of sale to the consuming public, thereby making such beverage container holder economically available to the buying public.

Still yet another object of the present invention is to provide a new beverage container holder which provides in the apparatuses and methods of the prior art some of the advantages thereof, while simultaneously overcoming some of the disadvantages normally associated therewith.

Still another object of the present invention is to provide a new beverage container holder for providing an adjustably positionable device for holding a beverage to a structure.

Yet another object of the present invention is to provide a new beverage container holder which includes a receptacle member for holding a beverage container coupled to an elongate arm member. A connection means connects the arm member to an clamping assembly designed for detachable attachment to a structure. The connection means includes a first pivot member, a second pivot member, and a rotation member to permit selective and adjustable positioning of the receptacle member in relation to the structure.

Still yet another object of the present invention is to provide a new beverage container holder that allows a user to adjustably position a beverage container for maximum convenience.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
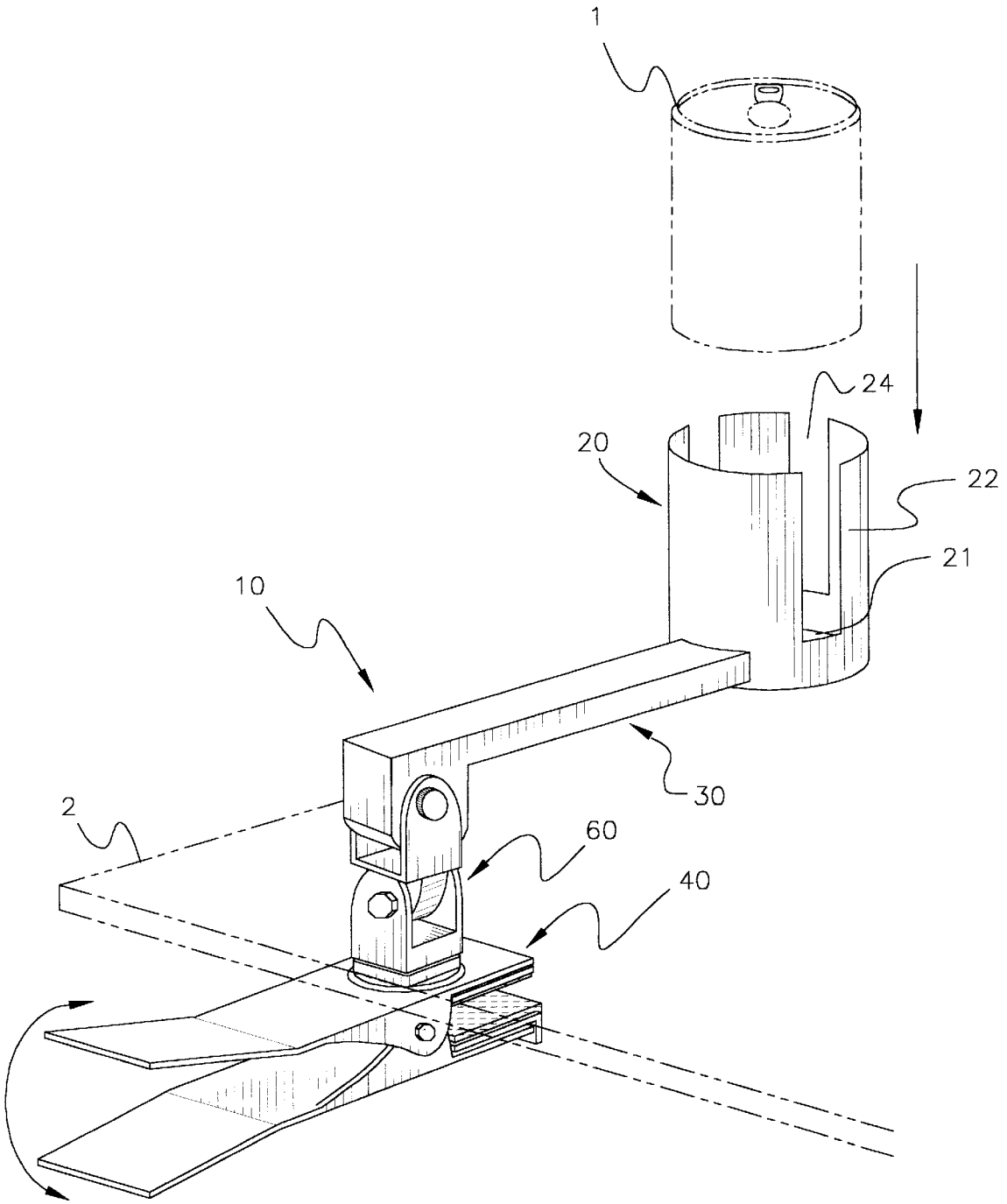
FIG. 1 is a perspective view of a new beverage container holder according to the present invention mounted to a structure and showing the placement of a beverage container in the receptacle member.
Figure 2:
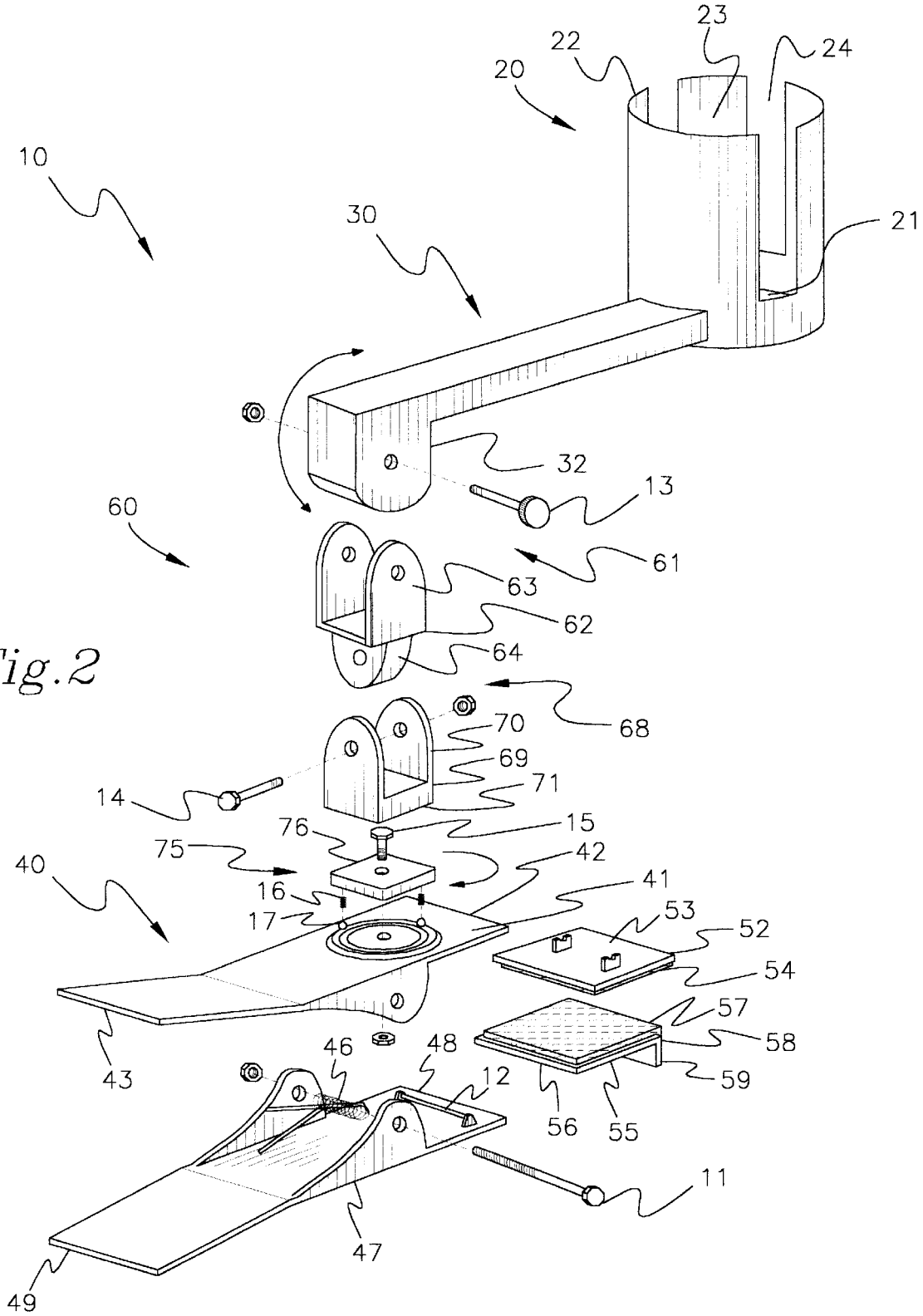
FIG. 2 is an exploded perspective view of the present invention.
Figure 3:
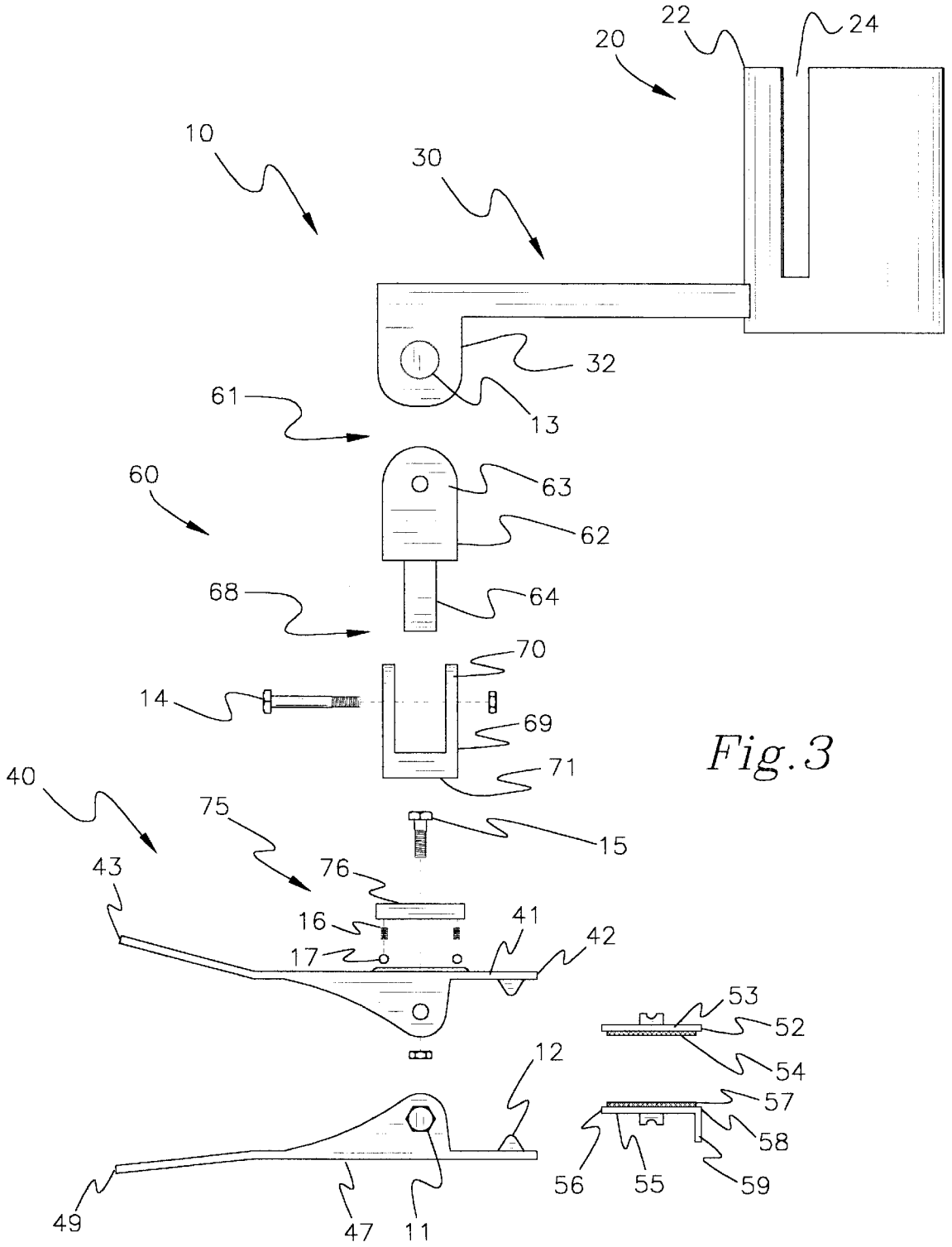
FIG. 3 is an exploded side view of the present invention.

With reference now to the drawings, and in particular to FIGS. 1 through 3 thereof, a new beverage container holder embodying the principles and concepts of the present invention and generally designated by the reference numeral 10 will be described.

As best illustrated in FIGS. 1 through 3, the beverage container holder 10 generally comprises a receptacle member 20 for holding a beverage container 1 coupled to an elongate arm member 30. A connection means 60 connects the arm member 30 to an clamping assembly 40 designed for detachable attachment to a structure 2. The connection means 60 includes a first pivot means 61, a second pivot means 68, and a rotation means 75 to permit selective and adjustable positioning of the receptacle member 20 in relation to the structure 2.

The receptacle member 20 has a bottom wall 21 and a side wall 22 which defines a holding cavity 23 designed for accepting a beverage container 1. As shown in FIG. 1, the receptacle member 20 is preferably cylindrical in shape with a cylindrical side wall 22. The side wall 22 has a plurality of elongate slots 24 that extend from the upper edge of the side wall 22 towards the bottom wall 21.

As shown in FIGS. 2 and 3, the clamping assembly 40 includes a pair of clamping arms 41,47. Each clamping arm 41,47 has a clamping end 42,48 and a lever end 43,49. The second clamping arm 47 is pivotally coupled to the first clamping arm 41 by a fastener 11 so that the inner surfaces of the clamping arms face one another. A spring 46 functions as biasing means to bias the clamping ends 42 of the clamping arms towards each other so that the clamping assembly 40 may be attached to a structure 2 by pinching the structure 2 between the two clamping ends 42.

Preferably, the clamping assembly 40 also include a first and second clamp pad 52,55 each having a mounting surface 53,56 and a gripping surface 54,57. The first clamp pad 52 is positioned towards the clamping end 42 of the first clamping arm 41 while the second clamp pad 55 is positioned towards the clamping end 48 of the second clamping arm 47. The mounting surface 53,56 of each clamp pad 52,55 is pivotally mounted the inner surface of their respective clamping arm 41,47 by a pivot mount 12. Preferably, the gripping surfaces 54,57 of both clamp pads 52,55 are made of a non-skid material, such as rubber, to help hold the clamp pads 52, 55 to a structure 2 pinched between the clamping arms 41,47.

With reference to FIGS. 2 and 3, a structure abutment flange 59 extends perpendicular from the second clamp pad second mounting surface 56 and is positioned at the distal end 58 of the second clamp pad 55. The structure abutment flange 59 is designed for abutting the structure 2 when the clamping assembly 40 is attached to the structure 2. Preferably, the structure abutment flange 59 has a non-skid surface that abuts the structure 2 to help hold the clamping assembly 40 to the structure 2.

One end of the arm member 30 is attached to the receptacle member 20. In an optional embodiment, the arm member 30 may be telescopic (not shown) to permit extension of its length to permit adjustable positioning of the receptacle member 20.

As shown in FIG. 2, the first pivot means 61 includes a first pivot member 62 having a first upper portion 63 and a first lower portion 64. The extension arm member second end 32 is pivotally coupled to the first pivot member upper portion 63 by a fastener 13 such that the receptacle member 20 is pivotable in the first plane.

The second pivot means 68 is designed for pivoting the receptacle member 20 in a second plane transverse to the first plane. The second pivot means 68 includes a second pivot member 69 having a second upper portion 70 and a second lower portion 71. The first pivot member lower portion 64 is pivotally coupled to the second pivot member upper portion 70 by a fastener 14 such that the receptacle member 20 is pivotable in the second plane.

The rotation means 75 is designed for rotating the receptacle member 20 in a third plane perpendicular to both the first plane and the second plane. The rotation means 75 including a rotation member 76. The lower portion 71 of the second pivot member is coupled to the rotation member 76 while the rotation member 76 is rotatively mounted to the outer surface of the first clamping arm 41 by a fastener 15 to permit rotation of the receptacle member 20 in the third plane. As shown in FIG. 2, a spring 16 and ball bearing 17 assembly may be included to help smooth rotation of the rotation member 76 on the first clamping arm 41.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beverage container holder for mounting to a structure, comprising:

a receptacle member for holding a beverage container;

an arm member having a first end and a second end, said first end being coupled to said receptacle member;

a clamping assembly for detachable attachment to a structure;

a connection means for connecting said arm member to said clamping assembly, said connection means including a first pivot means, a second pivot means, and a rotation means;

said first pivot means for pivoting said receptacle member in a first plane;

said second pivot means for pivoting said receptacle member in a second plane transverse to said first plane;

said rotation means for rotating said receptacle member in a third plane perpendicular to both said first plane and said second plane, wherein said clamping assembly includes: a first clamping arm having a first clamping end, a first lever end, a first outer surface, and a first inner surface; a second clamping arm having a second clamping end, a second lever end, a second outer surface, and a second inner surface, said second clamping arm being pivotally coupled to said first clamping arm, said second inner surface facing said first inner surface; and a biasing means for biasing said first clamping end and said second clamping end towards each other, a first clamp pad and a second clamp pad, said first clamp pad having a first mounting surface and a first gripping surface, said first clamp pad being positioned towards said first clamping arm first clamping end, said first clamp pad first mounting surface being pivotally mounted to said first clamping arm first inner surface, said first clamp pad gripping surface comprising a non-skid material, said second clamp pad having and second mounting surface, a second gripping surface, a distal end, and a proximal end, said second clamp pad being positioned towards said second clamping arm second clamping end, said second clamp pad distal end being positioned towards said second clamping arm second clamping end, said second clamp pad proximal end being positioned towards said second clamping arm second lever end, said second clamp pad second mounting surface being pivotally mounted to said second clamping arm second inner surface, said second clamp pad gripping surface comprising a non-skid material; and a structure abutment flange being extended substantially perpendicular from said second clamp pad second mounting surface, said structure abutment flange being positioned at said second clamp pad distal end, said structure abutment flange being for abutting a structure when said clamping assembly is attached to a structure.

2. The beverage container holder of claim 1, wherein said receptacle member has a side wall and a bottom wall, said side wall defining a holding cavity for accepting a beverage container therein.

3. The beverage container holder of claim 2, wherein said receptacle member is cylindrical and said side wall is cylindrical.

4. The beverage holder of claim 2, wherein said side wall has an upper edge, and wherein said side wall has a plurality of elongate slots therethrough, said slots being extended from said side wall upper edge towards said bottom wall.

5. The beverage holder of claim 1, wherein said arm member is telescopic to permit extension of the length of said arm member to permit adjustable positioning of said receptacle member.

6. A beverage container holder for mounting to a structure, comprising:

a receptacle member for holding a beverage container, an arm member having a first end and a second end, said first end being coupled to said receptacle member;

a clamping assembly for detachable attachment to a structure;

a connection means for connecting said arm member to said clamping assembly said connection means including a first pivot means, a second pivot means, and a rotation means, said first pivot means for pivoting said receptacle member in a first plane;

said second pivot means for pivoting said receptacle member in a second plane transverse to said first plane;

said rotation means for rotating said receptacle member in a third plane perpendicular to both said first plane and said second plane;

wherein said first pivot means includes a first pivot member having a first upper portion and a first lower portion, said extension arm member second end being pivotally coupled to said first pivot member upper portion such that said receptacle member is pivotable in said first plane;

wherein said second pivot means includes a second pivot member having a second upper portion and a second lower portion, said first pivot member lower portion being pivotally coupled to said second pivot member upper portion such that said receptacle member is pivotable in said second plane.

7. The beverage holder of claim 6, wherein said first pivot member lower portion is pivotally coupled to said second pivot member upper portion by a fastener.

8. The beverage holder of claim 6, wherein said rotation means includes a rotation member, said lower portion of said second pivot member being coupled to said rotation member, said rotation member being rotatively mounted to said first outer surface of said first clamping arm to permit rotation of said receptacle member in said third plane.

9. The beverage holder of claim 8, wherein said rotation member is rotatively mounted to said first outer surface of said first clamping arm by a fastener to permit rotation of said receptacle member in said third plane.

10. A beverage container holder for mounting to a structure, comprising:

a cylindrical receptacle member for holding a beverage container, said receptacle member having a cylindrical side wall and a bottom wall, said side wall having an upper edge, said side wall defining a holding cavity for accepting a beverage container therein, said side wall having a plurality of elongate slots therethrough, said slots being extended from said side wall upper edge towards said bottom wall;

a telescopic elongate arm member having a first end and a second end, said first end being coupled to said receptacle member;

a clamping assembly for detachable attachment to a structure, said clamping assembly including:

a first clamping arm having a first clamping end, a first lever end, a first outer surface, and a first inner surface;

a second clamping arm having a second clamping end, a second lever end, a second outer surface, and a second inner surface, said second clamping arm being pivotally coupled to said first clamping arm, said second inner surface facing said first inner surface;

a biasing means for biasing said first clamping end and said second clamping end towards each other;

a first clamp pad having a first mounting surface and a first gripping surface, said first clamp pad being positioned towards said first clamping arm first clamping end, said first clamp pad first mounting surface being pivotally mounted to said first clamping arm first inner surface, said first clamp pad gripping surface comprising a non-skid material;

a second clamp pad having a second mounting surface, a second gripping surface, a distal end, and a proximal end, said second clamp pad being positioned towards said second clamping arm second clamping end, said second clamp pad distal end being positioned towards said second clamping arm second clamping end, said second clamp pad proximal end being positioned towards said second clamping arm second lever end, said second clamp pad second mounting surface being pivotally mounted to said second clamping arm second inner surface, said second clamp pad gripping surface comprising a non-skid material;

a structure abutment flange being extended substantially perpendicular from said second clamp pad second mounting surface, said structure abutment flange being positioned at said second clamp pad distal end, said structure abutment flange being for abutting a structure when said clamping assembly is attached to a structure;

a connection means for connecting said arm member second end to said clamping assembly, said connection means including a first pivot means, a second pivot means, and a rotation means;

said first pivot means for pivoting said receptacle member in a first plane, said first pivot means including a first pivot member having a first upper portion and a first lower portion, said extension arm member second end being pivotally coupled to said first pivot member upper portion by a fastener such that said receptacle member is pivotable in said first plane;

said second pivot means for pivoting said receptacle member in a second plane transverse to said first plane, said second pivot means including a second pivot member having a second upper portion and a second lower portion, said first pivot member lower portion being pivotally coupled to said second pivot member upper portion by a fastener such that said receptacle member is pivotable in said second plane; and said rotation means for rotating said receptacle member in a third plane perpendicular to both said first plane and said second plane, said rotation means including a rotation member, said lower portion of said second pivot member being coupled to said rotation member, said rotation member being rotatively mounted to said first outer surface of said first clamping arm by a fastener to permit rotation of said receptacle member in said third plane.

* * * * *